United States Patent [19]

Nederveld

[11] Patent Number: 4,884,739

[45] **Date of Patent: * Dec. 5, 1989**

[54] CONTAINER FOR PRODUCE AND THE LIKE

[75] Inventor: Terrill L. Nederveld, Ada, Mich.

[73] Assignee: Packaging Corporation of America, Evanston, Ill.

[ * ] Notice: The portion of the term of this patent subsequent to Feb. 24, 2004 has been disclaimed.

[21] Appl. No.: 913,599

[22] Filed: Sep. 29, 1986

Related U.S. Application Data

[63] Continuation-in-part of Ser. No. 823,679, Jan. 29, 1986, Pat. No. 4,645,122.

[51] Int. Cl.[4] ..... B65D 5/32

[52] U.S. Cl. ..... 229/109; 206/509; 229/23 R; 229/120; 229/916

[58] Field of Search ..... 229/23 R, 23 C, DIG. 11, 229/109, 120, 915, 916, 919; 206/509

[56] References Cited

U.S. PATENT DOCUMENTS

| | | | |
|---|---|---|---|
| 2,013,712 | 9/1935 | Evans | 229/DIG. 11 |
| 3,373,921 | 3/1968 | Crane | 229/23 R |
| 4,134,533 | 1/1979 | Heavner | 229/DIG. 11 |
| 4,211,358 | 7/1980 | Crane | 229/23 C |
| 4,277,015 | 7/1981 | Crane | 229/23 C |
| 4,304,351 | 12/1981 | Stollberg | 229/915 |
| 4,389,013 | 6/1983 | Hall et al. | 229/915 |
| 4,645,122 | 2/1987 | Nederveld | 229/23 R |

*Primary Examiner*—Gary Elkins

*Attorney, Agent, or Firm*—Neuman, Williams, Anderson & Olson; a

[57] ABSTRACT

A container for produce and the like is provided which is adapted to be arranged in stacked relation with a second container of like configuration. The container includes a central section having a bottom panel, upright side panels arranged in opposed spaced relation, top closure panels, first joiner panels interconnecting the bottom panel to the side panels, and second joiner panels interconnecting the side panels to corresponding top closure panels. The container also includes a pair of upright end sections fixedly secured to opposite end edges of the central section, the end sections coact with the bottom panel, first joiner panels and side panels to form a receptacle for accommodating the produce. Each end section has upwardly extending protruberances formed on the upper edge portion thereof which are adapted to interlock with the top closure panels and retain same in a closed position. The lower edge of each end seciton is provided with recesses which are vertically aligned with the protuberances formed on the upper edge portion. The inteior surface of each end section adjacent the receptacle has portions thereof which partition the recesses from the receptacle and thus shield the accommodated produce from the protuberances of a second contianer stacked therebeneath.

7 Claims, 4 Drawing Sheets

FIG. 5
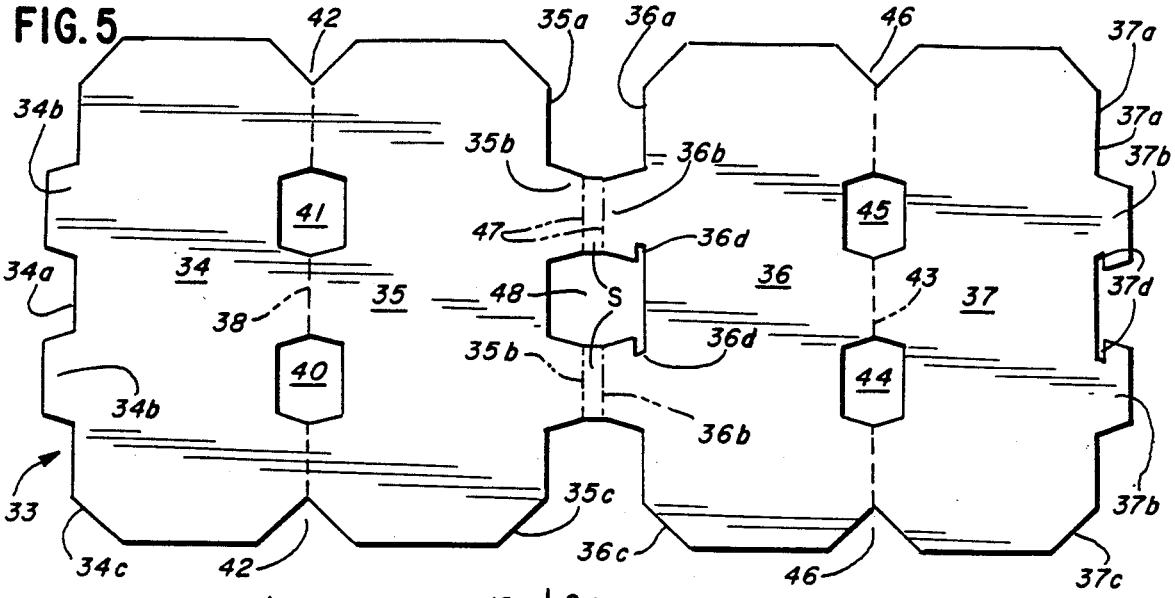
FIG. 6
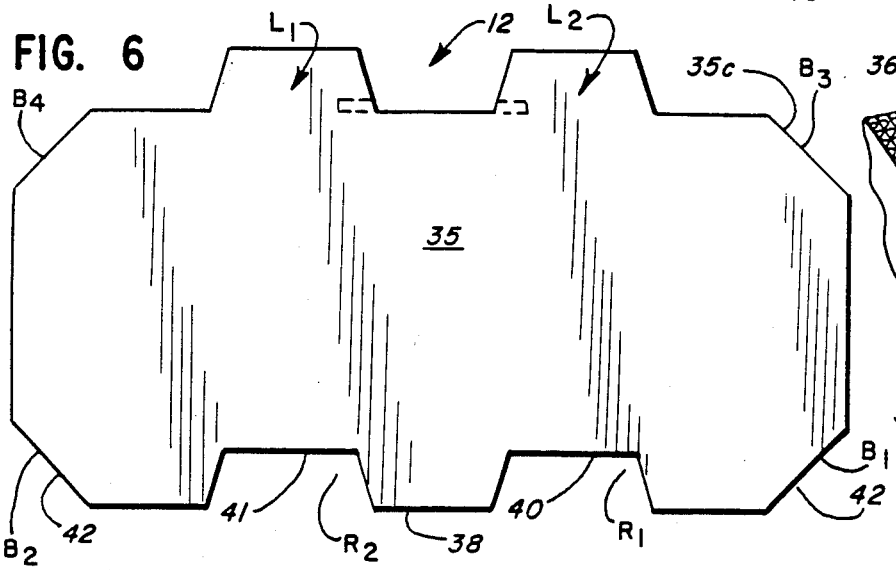
FIG. 7
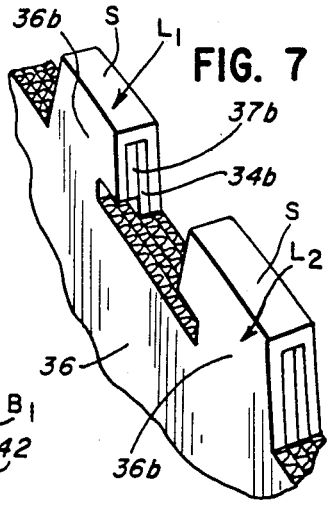
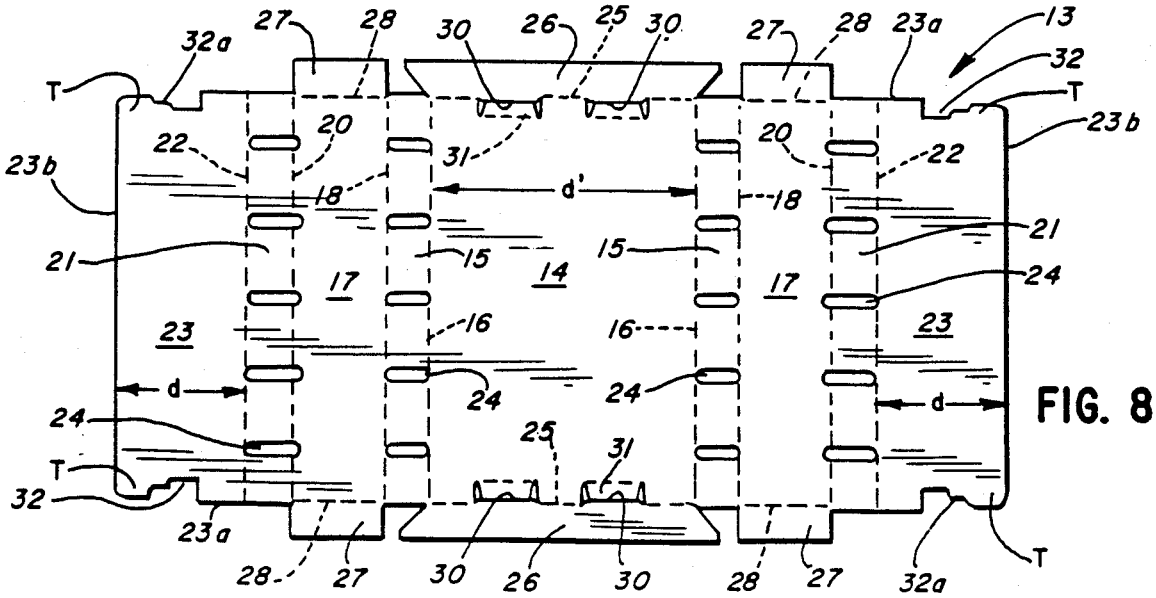
FIG. 8

FIG. 5A
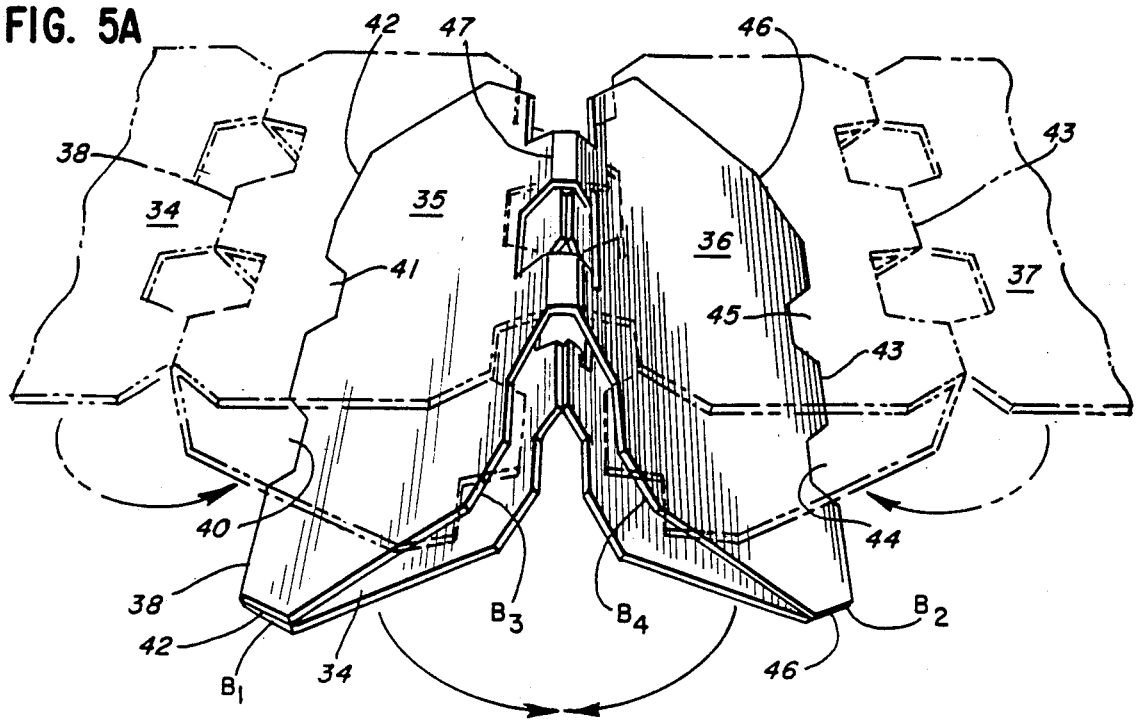
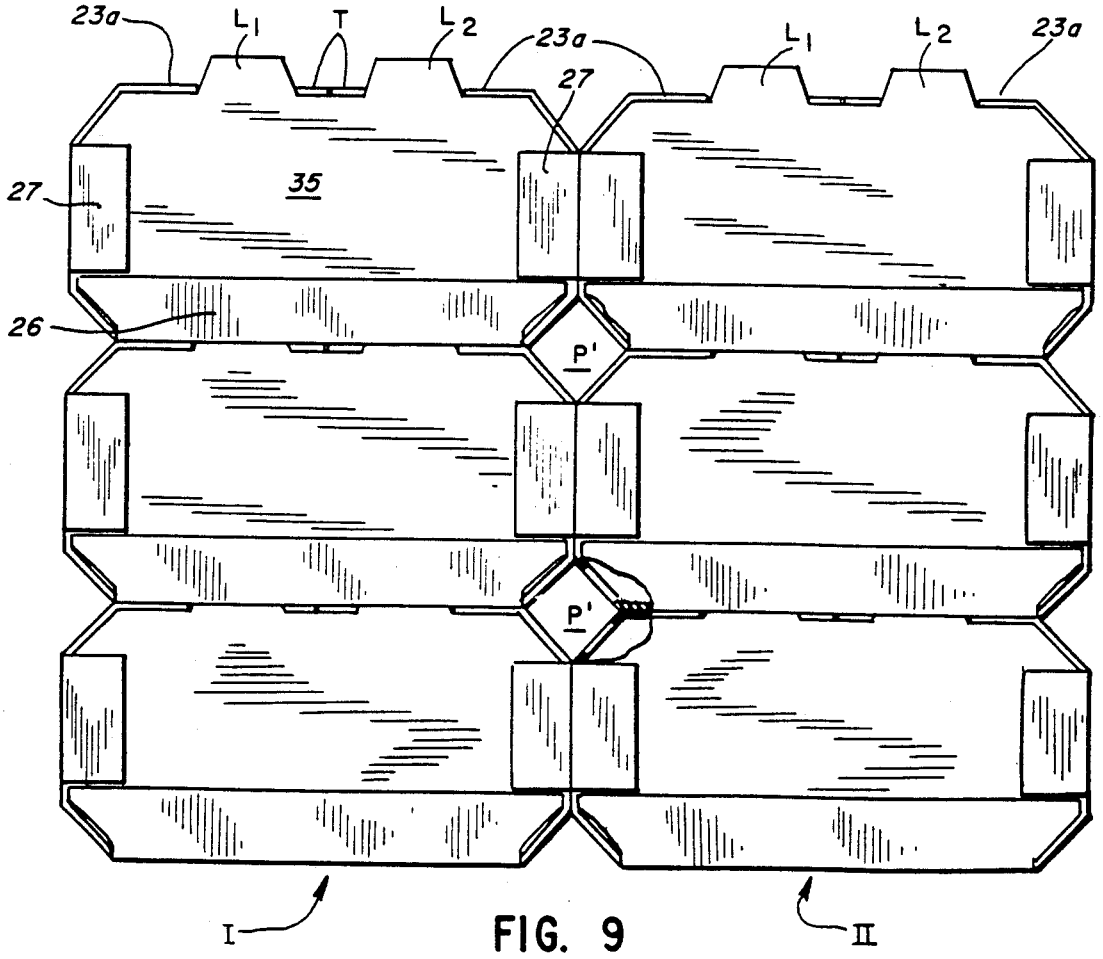
FIG. 9

CONTAINER FOR PRODUCE AND THE LIKE

This application is a continuation-in-part of my application, Ser. No. 823,679, filed Jan. 29, 1986, now U.S. Pat. No. 4,645,122 issued Feb. 24, 1987.

BACKGROUND OF THE INVENTION

In the bulk packaging of fresh produce (e.g., grapes) it is important that the container therefor provides adequate protection for the produce; provides ventilation for the accommodated produce; has adequate stacking strength even when stacked with like containers and the stacked containers are subjected to extreme climatic conditions; has a positive locking system wherein the loaded container remains closed even when subjected to abusive handling; shields the accommodated product from damage when a second container of like construction is stacked therebeneath; is of simple, inexpensive construction and capable of being readily manipulated manually into a closed condition; and is attractive in appearance enabling the accommodated produce to remain within the container when being displayed for retail sale to a customer. Prior containers of this general type fail to embody and possess all of the aforenoted virtuous characteristics.

SUMMARY OF THE INVENTION

Thus, it is an object of the invention to provide an improved container of the type described which is possessed of all of the aforenoted advantages.

It is a further object to provide an improved container which is capable of being readily interlocked in a stable stacked relation with containers of like construction.

It is a still further object to provide an improved container wherein the accommodated produce thereof is shielded from the locking lugs of a similar container when the latter is stacked therebeneath.

Further and additional objects will appear from the description, accompanying drawings, and appended claims.

In accordance with one embodiment of the invention, a container for the bulk handling of produce is provided. The container is formed of a central section and a pair of end sections affixed to opposite peripheral portions of the central section. Preferably the central and end sections are formed from blanks of double faced corrugated fibreboard. The end sections are of multiply thickness and the central section is of a single ply thickness.

The central section includes a bottom panel, upright side panels, top closure flaps, first joiner panels foldably interconnecting the bottom panel and the upright side panels, and second joiner panels interconnecting the side panels and the top closure panels. The upper edge portion of each end section is provided with at least one upwardly protruding means. The protruding means and the adjacent side edges of the top closure panels are provided with complemental locking means for retaining the top closure panels in a predetermined folded relation. When the top closure panels are disposed in the predetermined folded relation, the second joiner panels are in abutting relation with adjacent peripheral edge portions of the end sections and thus prevent lateral relative movement of the top closure flaps.

The underside of each end section is provided with recesses and the opposing side peripheral portions of the bottom panel are provided with openings aligned with the recesses of the corresponding end section. A portion of each end section partitions the interior of the container from the recesses formed in the underside of the end section.

DESCRIPTION

For a more complete understanding of the invention reference should be made to the drawings wherein:

FIG. 5 is a top plan view of a blank from which each end section of the container of FIG. 1 is formed.

FIG. 5*a* is a perspective end view of one end section in a partially set up condition; the blank in an unfolded and initial folded condition are shown in phantom lines.

FIG. 6 is an enlarged side elevational view of the end section per se.

FIG. 7 is a fragmentary perspective view of the top edge portion of the end section of FIG. 6.

Figure 1:
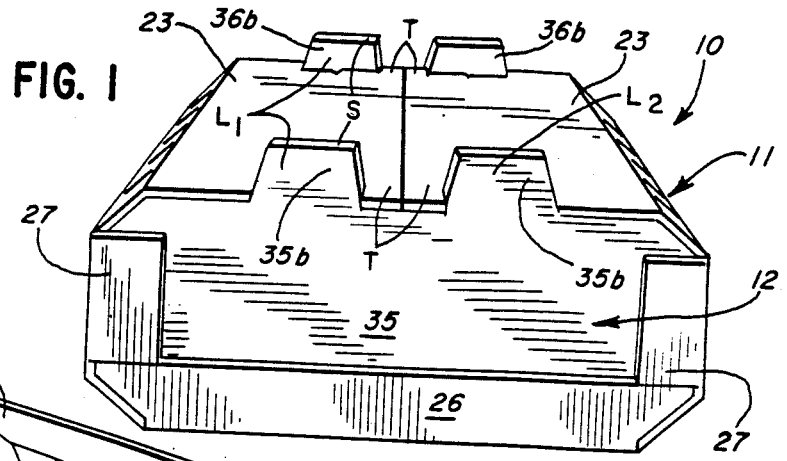
FIG. 1 is a perspective end view of one embodiment of the improved container with the top closure panels locked in a closed position.

FIG. 8 is a top plan view of a blank from which the central section of the container of FIG. 1 is formed.

FIG. 9 is an end view of a plurality of containers arranged in two stacks, said stacks being disposed in side by side relation.

Figure 10:
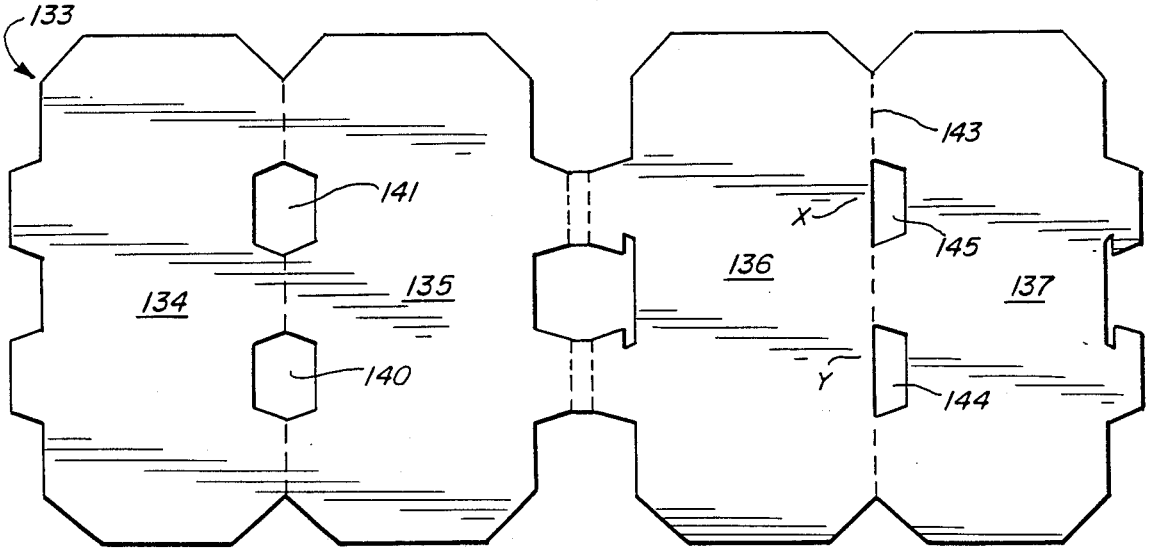

FIG. 10 is similar to FIG. 5 but shows a blank for an end section of a modified container.

Figure 11:
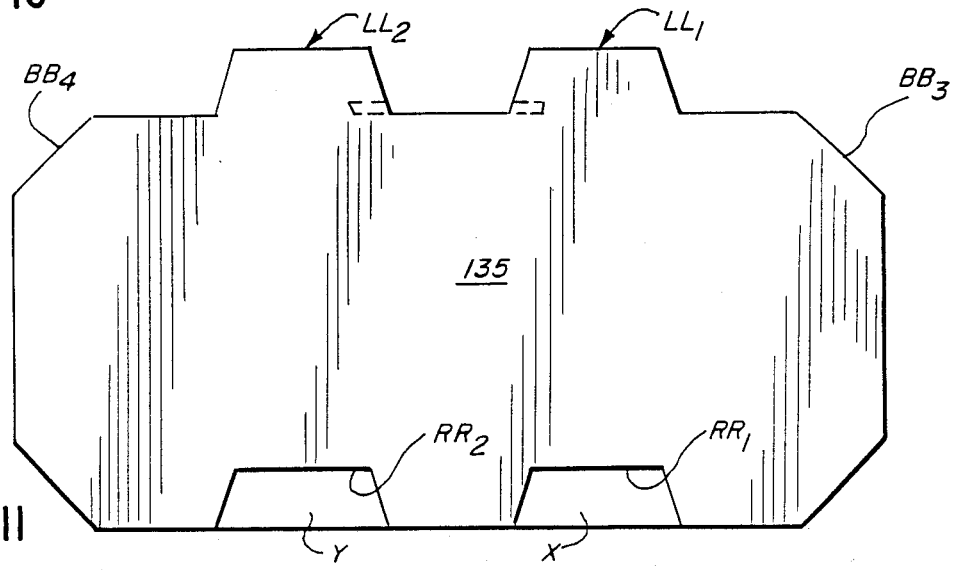

FIG. 11 is an enlarged elevational view of the exposed side of an end section formed from the blank of FIG. 10.

Figure 12:
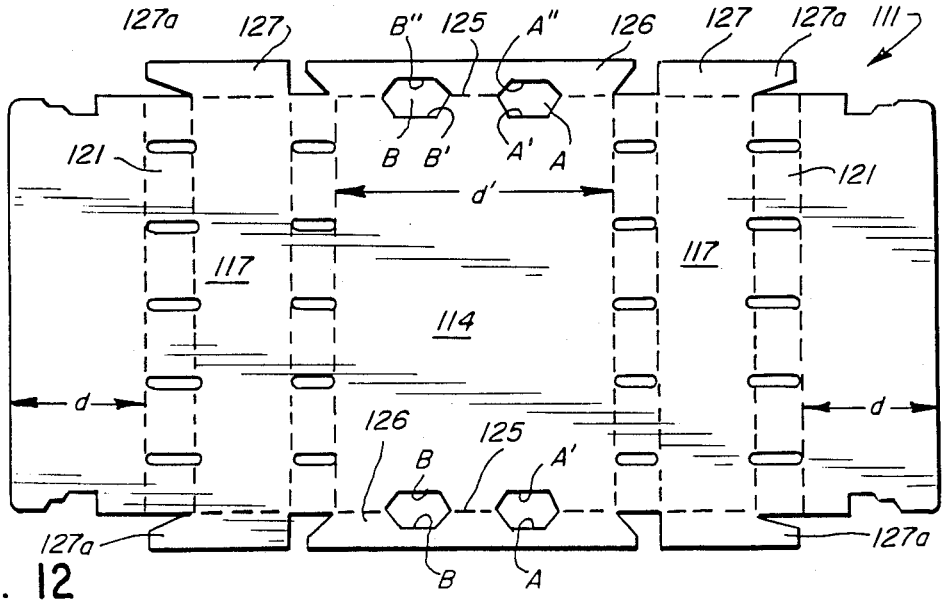

FIG. 12 is a top plan view of a blank from which is formed the central section of the modified container.

Figure 2:
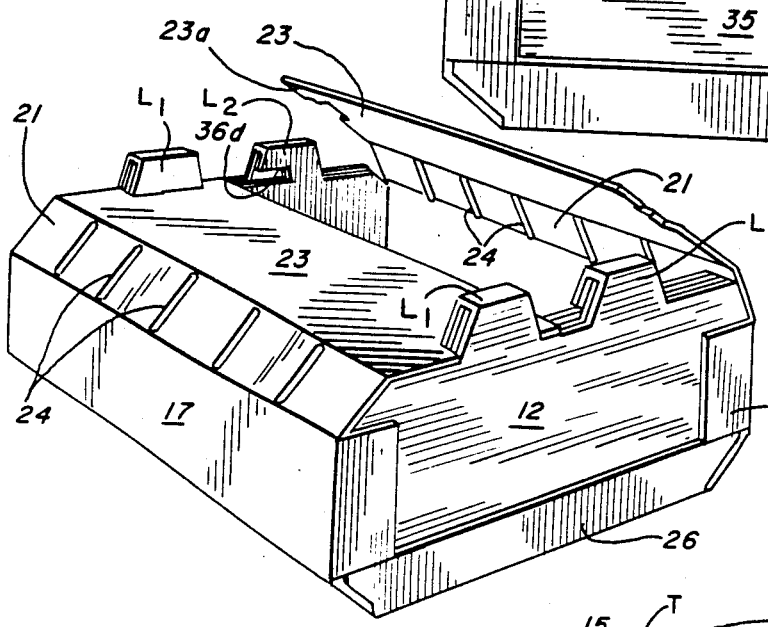
FIG. 2 is a perspective view of the container of FIG. 1 and showing one top closure flap in a partially open position.
Figure 3:
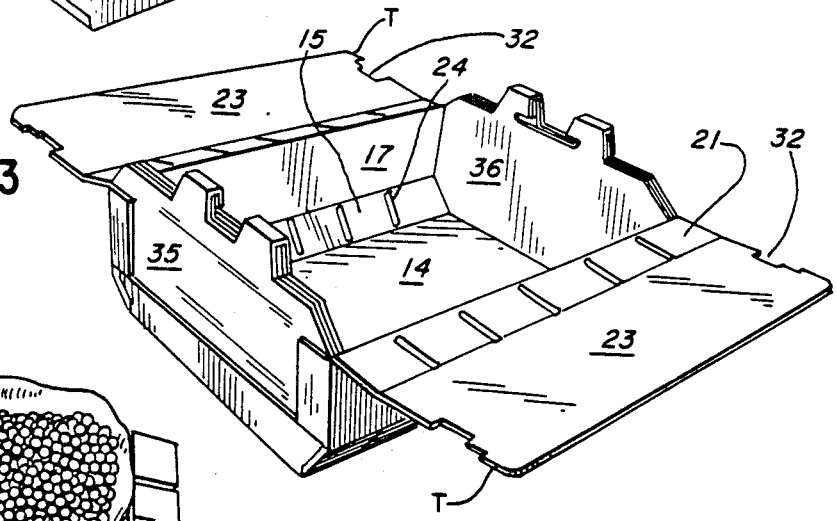
FIG. 3 is a perspective top view of the container of FIG. 1 and showing the top closure panels in a fully open position and the container ready for loading.
Figure 4:
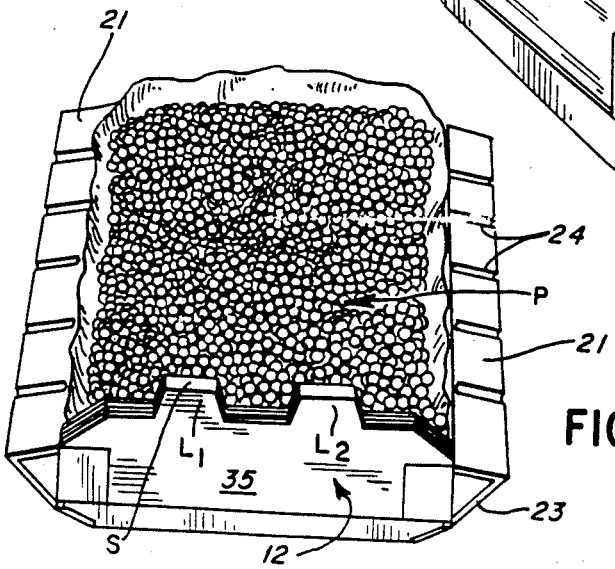
FIG. 4 is a perspective top view of a fully loaded container with the top closure panels thereof fully open and exposing the accommodated produce.

Referring now to the drawings and more particularly to FIGS. 1–3, one embodiment of an improved container 10 is shown which is suitable for accommodating in bulk form fresh produce P such as table grapes and the like, see FIG. 4. Basically, container 10 is formed of a central section 11 and a pair of upright end sections 12 which are affixed by adhesive, staples or the like to opposite peripheral portions of the central section. Both the central and end sections are preferably formed of plies of double faced corrugated fibreboard material.

The central section 11 is formed from a blank 13, see FIG. 8, of single ply double faced, corrugated, fibreboard material which has been pre-treated so as to be moisture resistant. Blank 13 includes a bottom panel 14, preferably of rectangular configuration; a pair of relatively narrow first joiner panels 15 connected by foldlines 16 to the elongated opposed side edges of the bottom panel; and a pair of upright side panels 17 connected by foldlines 18 to the joiner panels. Foldlines 16 and 18 are disposed in spaced parallel relation. Connected by foldlines 20 to peripheral portions of the side panels 17 opposite foldlines 18 are a pair of relatively narrow second joiner panels 21. Disposed outwardly from the second joiner panels 21 and connected thereto by foldlines 22 are top closure panels 23. As will be noted in FIG. 8, each of the joiner panels 15 and 21 is provided with a plurality of openings 24 for ventilation. Connected by foldlines 25 to the opposite shorter peripheral portions of bottom panel 14 are a pair of flaps 26, sometimes referred to as glue flaps. In a similar manner, a pair of glue flaps 27 are connected by foldlines 28 to the shorter peripheral portions of side panels 17. As seen in FIG. 8, each foldline 25 is interrupted by a pair of relatively spaced openings 30. Each opening 30 has a yieldable tab 31 extending therein from a perimetric portion of the opening disposed inwardly from the adjacent glue flap 26. The function of the openings 30 and tabs 31 will be described more fully hereinafter.

Each narrow end edge **23*a* of each top closure panel is provided with a notch 32 spaced a predetermined distance inwardly from the outer edge 23*b* of the top closure panel 23 so as to form a tongue T. The side of each notch 32 adjacent the tongue is provided with a step 32*a*. The notches and tongues form a locking component and will be described more fully hereinafter. The dimension d of each closure panel 23, as shown in FIG. 8, is approximately one-half the dimension d' of the bottom panel 14 so that, when the closure panels 23 are in the closed position, as shown in FIG. 1, the edges 23*b* of the panels 23** will be in close proximity to one another and thus, substantially conceal the produce P accommodated within the interior of the container.

Each end section 12 is preferably of like configuration and is formed from a blank 33 of single ply double faced corrugated fibreboard material which has been pre-treated so as to be moisture resistant. Blank 33, as seen in FIG. 5, includes four panels 34, 35, 36 and 37 which are arranged in side by side relation. Panels 34,35 are connected by foldline 38 which is interrupted by a pair of openings 40 and 41 of like configuration. Approximately one-half of each opening 40,41 extends into panel 34 and approximately the remaining one-half extends into panel 35. The ends of foldline 38 terminate in V-shaped notches 42.

The outer edge **34*a*, 37*a* of the panels 34,37 are provided with spaced lugs or protuberances 34*b*,37*b*, see FIG. 5**.

Panels 36,37 are connected by foldline 43 which is interrupted by openings 44,45 in the same manner as foldline 38 is interrupted by openings 40,41. The ends of foldline 43 terminate in V-shaped notches 46. Panels 34,37 are of like configuration and similarly panels 35,36 are of like configuration.

The edges **35*a*,36*a* of panels 35,36 respectively, which are opposite foldlines 38,43, are provided with laterally extending protuberances 35*b*,36*b*. The protuberances are interconnected by a double foldline 47. Foldline 47 is interrupted by a large opening 48 which has approximately one-half thereof extending towards panel 35 and approximately the other one-half extending towards panel 36. Thus, by reason of the opening 48, each protuberance 35*b*,36*b* is formed into a pair of laterally spaced lugs $L_1$ and $L_2$. see FIG. 1. Corresponding lugs are separated from one another by a narrow strip S which is formed between the foldlines comprising the double foldline 47. The narrowness of each strip S approximates the thickness of two plies of the double faced corrugated fibreboard material of which blank 33 is formed. The reason for this narrowness of dimension is apparent from FIG. 7 wherein corresponding peripheral protuberances 34*b*,37*b* of panels 34,37 are disposed in face to face relation between protuberances 35*b*,36*b* thereby forming lug $L_1$ and $L_2$, when blank 33 is set up to form an end section 12. In the setup end section, each narrow strip S overlies the upper edges of protuberances 34*b*,37*b* as seen in FIG. 7**.

When blank 33 is set up to form an end section 12, the outermost panels 34,37 of the blank are initially folded about their respective foldline 38,43 so as to underlie, respectively, panels 35,36, see FIG. **5*a***. *Subsequently, the blank 33 after the aforesaid initial folding, is folded about double foldline 47 whereupon the protuberances 34b,37b* are sandwiched between corresponding protuberances **35*b*,36*b*. When the end section 12 is fully set up from blank 33, the halves of openings 40, 44 and 41, 45 coact to form a pair of recesses or pockets $R_1$ and $R_2$ along the lower edge of each end section as seen more clearly in FIG. 6. Corners 34*c*, 35*c*, 36*c* and 37*c* of panels 34, 35, 36, and 37, respectively, are diagonally cut in a like manner as seen in FIG. 5 so that when the blank 33 is fully set up, the aforesaid corners coact to form bevel corner edges $B_3$ and $B_4$ along the upper edge of each end section, see FIG. 6. In a similar manner, by reason of the V-shape of notches 42**, the sides thereof coact to form bevel corner edges $B_1$, $B_2$ in the set up end section.

It will be noted in FIG. 5, that opposing sides of protuberances **37*b* are provided with short slots 37*d* which are laterally aligned with one another. In a like manner, protuberances 36*b* are provided with short slots 36*d*. Corresponding slots 37*d* and 36*d* coact with one another when the blank 33 is fully set up, to form a locking component at each end section of the container, which is adapted to cooperate with the corresponding locking component previously described as including notch 32 and tongue T formed in the narrow edge of each closure panel 23. Preferably, the panels 34,37 are adhesively secured together when blank 33 is set up to form an end section 12**.

Once the end sections 12 have been fully set up as aforementioned, each end section is positioned so that the lower edge thereof will rest upon the interior or concealed surface of the bottom panel adjacent foldline 25. When positioning the end section on the bottom panel of blank 13, the recesses $R_1$,$R_2$ should be in vertical alignment with openings 30 which interrupt foldline 25. Once each end section is in place relative to the bottom panel 14, glue flaps 26 are folded upwardly about foldlines 25 and adhesively secured to the exterior or exposed surface of the corresponding end section. Subsequent to the flaps 26 being adhesively affixed to the end section exterior surfaces, the first joiner panel 15 and corresponding side panel 17 are folded upwardly as a unit about foldline 16. Because of the bevelled corners $B_1$ and $B_2$ of the end section, the first joiner panels 15 will abut the bevelled corners and be restrained thereby while the side panels 17 move to fully upright positions. When the side panel 17 is in its fully upright position it will abut the side edge portion of the end section. The glue flaps 27 extending laterally from the side panel are folded and adhesively secured to the exterior surface of the adjacent end section. Once the bottom panel and side panels have been secured to the end sections 12, the second joiner panels 21 and the top closure panels 23 are folded outwardly as seen in FIG. 3 whereby the container 10 is ready for loading. Subsequent to the container being loaded with produce P, the second joiner panels 21 and the corresponding closure panels 23 are folded as units about foldlines 20 until the joiner panels 21 abut the bevelled corners $B_3$,$B_4$ of the end sections 12. Once the joiner panels 21 are in abutting relation with the corners of the end sections, the closure panels 23 can be folded towards one another about foldlines 22 until they assume a predetermined or closed position, see FIG. 2. Because of sizing of the closure panels 23 relative to the lugs $L_1$,$L_2$, the closure panels will frictionally engage the corresponding lugs as the closure panels are manually pushed downwardly between the lugs until the step 32*a*, formed in the notch 32 in each end edge 23*a* of the closure panel 23, is aligned with the slot 36*d*,37*d* formed in the adjacent end section. Once the steps are aligned with the slots, the steps will automatically snap into interlocking relation with the end sections whereby the tongues T formed in the edges of the closure panels will be disposed between the lugs $L_1$,$L_2$ of the end sections, see FIG. 1. Because of the abutting engagement between the second joiner panels 21 and the corners $B_3$,$B_4$ of the end sections 12, the top closure panels 23 cannot move laterally relative to the lugs once they are in interlocking relation with the lugs. Thus, the possibility of the closure panels accidentally assuming an open or unlocked position is avoided.

Besides providing an effective means for locking the closure panels in a closed position, the lugs $L_1$,$L_2$ provide an effective means for stabilizing the container when in a stacked relation with other like containers, as seen in FIG. 9. When stacking the containers, the lugs $L_1$,$L_2$ of the lower container are inserted through the tabbed openings 30 formed in the periphery of the bottom panel 14 of the container disposed immediately above. As the lugs $L_1$,$L_2$ are being inserted through the corresponding openings 30, the tabs 31 formed in the openings will be distorted upwardly thereby preventing any portions of the accommodated produce from being crushed or defaced by the inserted lugs. The recesses $R_1$,$R_2$ formed along the lower edges of the end sections of the upper container, are sized so as to readily accommodate the lugs of the lower container when the containers are arranged in stacked relation.

Because the second joiner panels 21 and top closure panels 23 are not adhesively attached to the end sections, the accommodated produce may be attractively displayed for retail sale without being removed from the container, see FIG. 4. When so displayed, the closure panels 23 are folded outwardly and downwardly and the second joiner panels assume outwardly extending positions, thus providing substantial exposure of the produce both from the side as well as the top.

When the loaded containers are arranged in two or more stacks I,II on a pallet or the like and in a side by side relation, as seen in FIG. 9, the corners of the containers coact to form elongated ventilating passageways P'. The openings 24 formed in joiner panels 15,21 of each container communicate with the passageways P' thereby providing effective ventilation for the produce accommodated in the stacked containers.

A modified container which is similar in many respects to container 10 shown in FIG. 1 is formed from blanks 111 and 133, see FIGS. 12 and 10, respectively. The modifications embodied in the modified container primarily relate to the recesses $RR_1$ and $RR_2$ formed in the underside of each end section and in the side peripheral portions of the bottom panel of the central section blank III which are aligned therewith when the container is set up in the same manner as that described with respect to container 10.

Each end section of the modified container is of like construction and in the illustrated embodiment is formed from a blank 133, as shown in FIG. 10. Blank 133 and blank 33 are of like construction, except in blank 133, openings 144, 145 which interrupt the foldline 143 connecting panels 136, 137 only project into panel 137. By reason of this arrangement, when the blank 133 is set up to form the end section, segments X and Y of panel 136 are aligned with the recesses $RR_1$ and $RR_2$ and function as partitions separating the produce accommodating interior of the container from the recesses $RR_1$ and $RR_2$ formed by panels 134, 135 and 137. Thus, the accommodated produce is shielded from the lugs $LL_1$ and $LL_2$ of a similar container disposed therebeneath when a plurality of similar containers are arranged in stacked relation, similar to that shown in FIG. 9, and is not engaged and/or damaged by such lugs when they are disposed in the recesses $RR_1$ and $RR_2$ of the container stacked thereabove.

To facilitate positioning of the lugs $LL_1$ and $LL_2$ in corresponding recesses, when the containers are arranged in stacked relation, the foldlines 125 connecting glue flaps 126 to opposite sides of the bottom panel 114 are interrupted by a pair of openings A and B, see FIG. 12. Each opening A, B has a portion A', B' thereof extending into bottom panel 114. The extent to which portions A' and B' project into the bottom panel is substantially equal to the sum of the thickness of glue flap 126 and panels 134, 135 and 137, when all of the latter are arranged in face to face relation.

Each opening A, B has a second portion A", B" thereof which extends into the adjacent glue flap 126. The tapered configuration of portions A" and B" conform substantially to the tapered configuration of the respective portions of openings 140, 141 which extend into panels 134, 135 and the opening 144, 145 formed in panel 137. The recesses $RR_1$ and $RR_2$ are shaped so that the corresponding lugs $LL_1$ and $LL_2$ of a like container stacked therebeneath may easily be slidably accommodated therein and once the lugs are in place within the recesses, a stable stack of containers will be formed.

It should be noted in FIG. 12, that each glue flap 127, foldably connected to opposite ends of side panels 117, has an extension 127*a* which is disposed proximate to but spaced from a corresponding edge of a joiner panel 121. The extension is shaped so as to overlie in face to face relation the exposed exterior of each end section 112 in the vicinity of the upper beveled corners $BB_3$, $BB_4$ thereof. The flap extensions 127*a* serve a dual function: (a) they provide greater area for better adhesive attachment between the central section 111 and the end sections 112; and (b) the extensions provide reinforcement for the beveled corners $BB_3$, $BB_4$ of the container.

Because of the manner in which either blank 33 or 133 is folded when setting up the container end section, the latter is of four ply construction and thus, is possessed of very high strength in resisting both bending and compressive forces. The size and shape of the improved continer may vary from that shown and will depend upon the product to be accommodated therein.

The improved container is of simple, lightweight, inexpensive construction and is provided with substantial exposed areas on which attractive graphics or the like may be imprinted. The container may be unfolded so that the accommodated produce may be attractively displayed for retail sale without being removed from the container. The container is provided with suitable means for ventilating the accommodated produce even when the top closure panels are in a fully closed position and a plurality of containers are arranged in stacked relation. Either form of the improved container incorporates novel structural features which prevent relative movement of the top closure panels once they have assumed a closed position thereby enhancing the security of the interlocking relation between the closure panels and the end section lugs. Both containers incorporate structures for protecting the accommodated produce when loaded containers are arranged in stacked relation for storage or shipment.

I claim:

1. A container for produce and the like which is adapted to be arranged in stacked relation with a second container of like configuration, said container comprising a central section having a bottom panel, upright side panels arranged in opposed spaced relation, top closure panels, first joiner panels interconnecting the bottom and the side panels and being angularly disposed relative to said bottom and side panels, and second joiner panels interconnecting the side panels to corresponding top closure panels and being angularly disposed relative to said top closure and side panels, and a pair of rigid upright end sections disposed in opposed relation and fixedly secured to predetermined portions of said central section, said central section and said end sections coacting to form a receptacle for accommodating the produce, each end section having upwardly protruding means formed on an upper edge portion thereof for interlocking with a corresponding top closure panel and retaining the latter in a predetermined folded position relative to said side panel, when the top closure panels are in said folded portions, the second joiner panels of the central section engage corresponding edge portions of said end sections; each end section having recess means formed on a lower edge portion thereof and in substantially vertical alignment with the protruding means formed on the upper edge portion of said end section, and means angularly disposed relative to said central section bottom panel for partitioning said recess means from the receptacle and shielding the accommodated produce from the protruding means of the second container stacked therebeneath and when the latter protruding means are disposed within corresponding recess means of the container stacked thereabove.

2. The container of claim 1 wherein each recess formed in an end section has an open bottom and an open outwardly facing side.

3. The container of claim 1 wherein each end section has a multi-ply thickness and the partitioning means adjacent each recess has at least one ply thickness.

4. The container of claim 2 wherein each end section is formed from a blank having a plurality of panel segments arranged in side by side relation, adjacent panel segments being interconnected by foldlines, one of said foldlines interconnecting predetermined adjacent panel segments being interrupted by a pair of longitudinally spaced recess-forming openings, each of the latter openings protruding only into one of the predetermined adjacent panel segments, the other of the predetermined adjacent panel segments forming an end wall of the produce-accommodating receptacle, said end wall-forming panel segment having portions thereof adjacent the foldline, forming the means partitioning the recesses from the receptacle when said blank is set up to form the end section and each end section is secured to the central section.

5. The container of claim 4 wherein the central section thereof is formed from a blank having a bottom panel-forming first segment, side panel-forming second segments disposed on opposite sides of the first segment, and flaps connected by foldlines to opposite edges of the first segment for attachment to adjacent end sections, each of the latter foldlines being interrupted by a pair of longitudinally spaced openings, each opening having a first portion thereof extending into the first segment and a second portion thereof extending into the adjacent flap; said first and second portions of each opening being aligned respectively with a downwardly facing bottom and an outwardly facing side defining a recess formed in the end section to which the flap is attached.

6. The container of claim 5 wherein each second segment of the central section has foldably connected to opposite edges thereof second flaps for attachment to adjacent end sections.

7. The container of claim 6 wherein the second segments and the first segment of the central section blank are foldably interconnected by first joiner panel-forming third segments; each second segment is foldably interconnected to a top closure panel-forming fourth segment by a second joiner panel-forming fifth segment; each second flap having an extension proximate to but separated from an end edge portion of an adjacent fifth segment.

* * * * *

UNITED STATES PATENT AND TRADEMARK OFFICE

CERTIFICATE OF CORRECTION

PATENT NO. : 4,884,739

DATED : December 5, 1989

INVENTOR(S) : Terrill L. Nederveld

It is certified that error appears in the above-identified patent and that said Letters Patent is hereby corrected as shown below:

On the title page, item [57] ABSTRACT, last line, "contianer" should be --container--

Column 3, line 57, after "$L_2$" delete "." and substitute --,-- therefor

Column 5, line 61, "III" should be --111--

Column 6, line 54, "continer" should be --container--

Signed and Sealed this

Twenty-fifth Day of December, 1990

*Attest:*

HARRY F. MANBECK, JR.

*Attesting Officer*

*Commissioner of Patents and Trademarks*